United States Patent [19]

Angwin

[11] 4,445,693

[45] May 1, 1984

[54] BULLET TRAP

[75] Inventor: Richard B. Angwin, Oshkosh, Wis.

[73] Assignee: Laminations Corporation, Neenah, Wis.

[21] Appl. No.: 305,189

[22] Filed: Sep. 24, 1981

[51] Int. Cl.[3] ..... F41J 1/12

[52] U.S. Cl. ..... 273/404

[58] Field of Search ..... 273/410, 404, 407; 73/167

[56] References Cited

U.S. PATENT DOCUMENTS

| | | | |
|---|---|---|---|
| 197,398 | 11/1877 | O'Neil | 273/410 X |
| 941,642 | 11/1909 | Maxim | 273/410 |
| 2,613,934 | 10/1952 | Tabler | 273/404 |
| 2,713,262 | 7/1955 | Webster | 73/167 |
| 2,812,947 | 11/1957 | Fatzinger et al. . | |
| 3,367,660 | 2/1968 | Di Maggio | 273/404 |
| 3,371,963 | 3/1968 | Weller | 297/445 |
| 3,512,778 | 5/1970 | Allen . | |
| 3,720,411 | 3/1973 | De Vogelaere | 273/404 |
| 4,334,423 | 6/1982 | Rainis et al. | 73/167 X |

FOREIGN PATENT DOCUMENTS

| | | | |
|---|---|---|---|
| 2932778 | 3/1981 | Fed. Rep. of Germany | 273/404 |
| 20179 | 3/1900 | Switzerland | 273/407 |
| 129327 | 12/1928 | Switzerland | 273/407 |
| 2065277 | 6/1981 | United Kingdom | 273/410 |

OTHER PUBLICATIONS

Popular Mechanics, 11-1978, p. 208, Indoor/Outdoor Target.

*Primary Examiner*—Paul E. Shapiro

*Attorney, Agent, or Firm*—Andrus, Sceales, Starke & Sawall

[57] ABSTRACT

A bullet trap provides a housing which retains alternate layers of baffles formed of multi-ply paper laminate to sandwich particulate material such as pea gravel to fragment and disintegrate the bullet. Plural trap portions are provided for multiple use while the particulate matter can be readily removed to assist in transputating the trap without undue weight.

19 Claims, 3 Drawing Figures

BULLET TRAP

CROSS REFERENCE TO RELATED APPLICATIONS

A portion of the disclosure in this application is also disclosed and/or claimed in the following concurrently filed applications:

Ser. No. 06/305,190, filed, Sept. 24, 1981, in the name of John V. Maring and Larry J. Bricco and entitled "Stacked Paper Target", now abandoned, and Ser. No. 06/305,191, filed, Sept. 24, 1981, in the name of Larry J. Bricco and entitled "Multi-Ply Paper Target".

BACKGROUND OF THE INVENTION

The present invention relates to a bullet trap utilizing one or more paper components.

Bullet traps for use in a practice shooting range have included a bullet spending or de-energizing chamber surrounded by metal walls which allow a bullet to ricochet back and forth until it is spent. Nikoden, U.S. Pat. No. 3,701,532, shows such a bullet trap having a cylindrical-shaped bullet spending chamber. Another known bullet trap of this type has a spiral-shaped spending chamber. Bullet traps utilized for ballistics purposes on the other hand generally include an elongated chamber filled with newspaper or clay or other relatively soft energy-absorbing material so that the bullet may be recovered intact and undamaged. Such bullet traps, however, are bulky, heavy, difficult to install and expensive. Further, some prior art traps must be installed in a stationary position and cannot be readily moved to different shooting locations.

SUMMARY OF THE INVENTION

A bullet trap includes a housing defining a bullet spending chamber, and a bed containing layers of different energy absorbing material contained within the housing for stopping a fired bullet. The trap is relatively compact and portable so that it can be easily moved to different shooting locations.

The housing has an open front and back which provides for a reversible bullet trap suitable for multiple use. The layers of energy absorbing material are positioned transversely in the housing parallel to the open front and back. These layers may comprise baffles composed of a multi-ply paper laminate construction. The laminate construction is preferably convolutely wound utilizing recycled chipboard for each ply. Each ply has a caliper of from about 0.025 to about 0.035 inches, and a density of from about 3.0 to about 3.5 pounds per point of caliper. Such laminate construction provides a material that is non-shattering and non-splintering and relatively light in weight.

Layers of particulate material having an effective diameter of from about $\frac{3}{8}$ inches to about $\frac{1}{8}$ inches may also be employed. The layers of particulate material shred or disintegrate the bullet upon impact thereby providing a compact bullet trap. In addition, the bullet trap provides a convenient means for removing the particulate material so that the trap may be portable and easily transported from place to place without undue weight.

Alternate layers of energy absorbing material preferably are formed of convoluted chipboard to provide baffles and the particulate matter preferably includes pea gravel. Pea gravel has been found to be particularly advantageous for use as the particulate material for shredding a bullet due to the hardness of each particle and the ability to tightly pack the particles in a column to that the interstines between individual particles is minimal. The ratio of the thickness of the baffle to the particulate layer is 1 to 2, and the ratio of the thickness of the first baffle to the third baffle is 1 to 3.

The present invention thus provides a portable bullet trap that effectively stops a fired bullet and yet is light in weight, inexpensive, and easy to install.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figures 1, 2, 3:
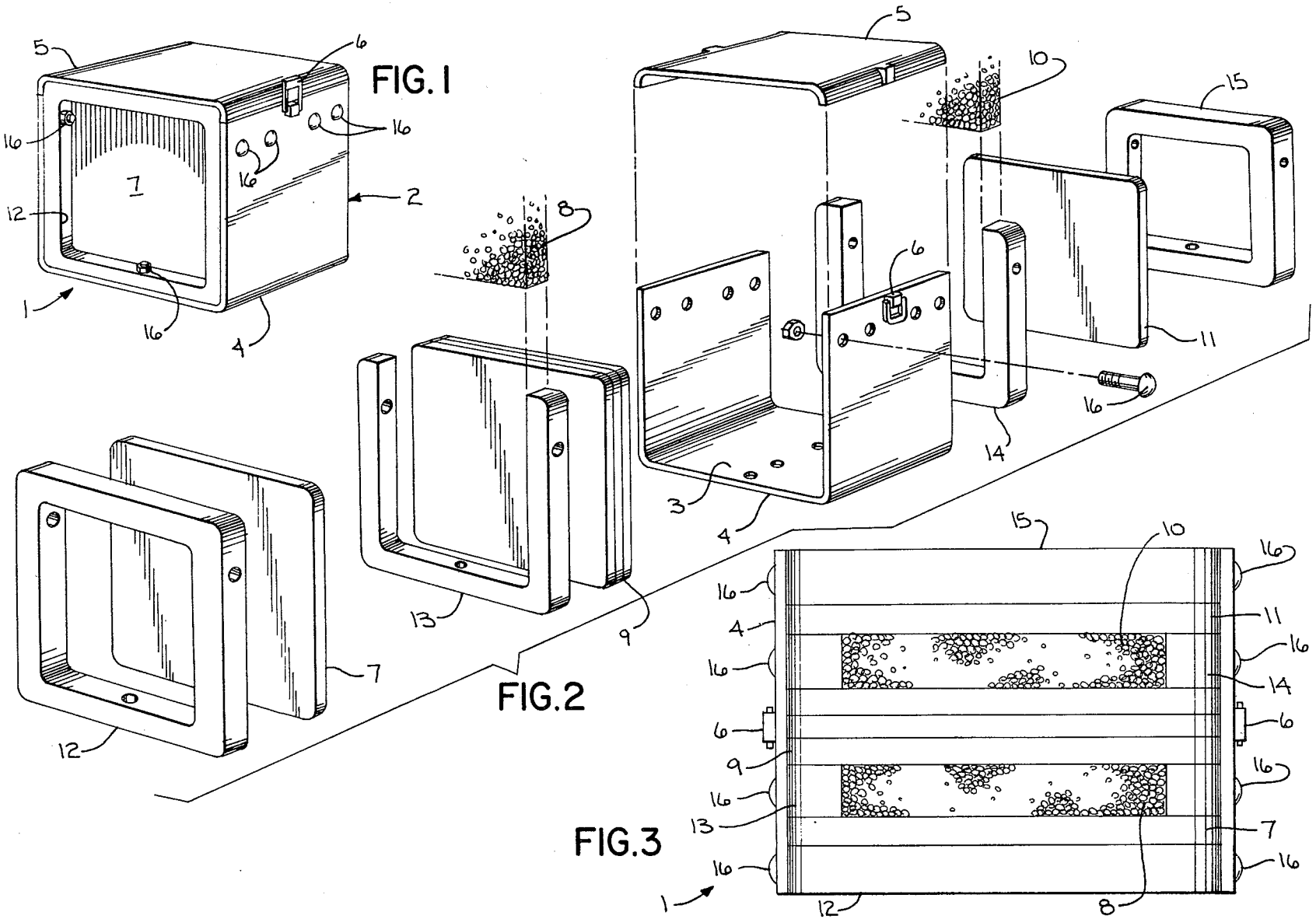
FIG. 1 is a view in perspective of a bullet trap constituting a preferred embodiment of the present invention.
FIG. 2 is an exploded view of the components of the bullet trap of FIG. 1.
FIG. 3 is a plan view of the bullet trap of FIG. 1 with its cover removed to show the various layers of energy absorbing material.

A bullet trap 1 includes a housing 2 enclosing a bed of energy absorbing material for stopping a bullet. The housing 2 provides a bullet de-energizing or spending chamber 3 and includes a U-shaped shell 4 and a removable cover 5. The housing 2 has both an open front and an open back, and is generally rectangular in cross section and tubular in shape with shell 4 forming the bottom and side walls, and cover 5 forming the top. As seen in FIG. 1, cover 5 is removably attached to the top of shell 4 by means of a pair of latches 6 of conventional design. The cover 5 may alternatively be hinged to one side of the shell 4 if desired. The housing 2 may be composed of metal, wood, or the like, but is preferably composed of convolutely wound plies of chipboard, as will hereinafter be described.

A de-energizing bed for stopping a fired bullet is located within spending chamber 3 and enclosed by housing 2. The de-energizing bed includes a plurality of layers 7–11 of energy absorbing material positioned transversely in chamber 3 with respect to the intended line of flight of a bullet and parallel to the open front and back of housing 2 and to each other. Alternating layers 7, 9 and 11 are of energy absorbing material in the form of a solid baffle of convolutely wound chipboard positioned axially along the central tubular axis of housing 2. Layers 8 and 10 are disposed between layers 7, 9 and 11 and are of an energy absorbing material in the form of particulate material having an effective diameter of from about $\frac{1}{8}$ to about $\frac{3}{8}$ inches. Layers 7, 9 and 11 are preferably equally spaced from one another by means of ribs or spacers 12–15, as will hereinafter be described.

The first or front layer 7 is in the form of a solid baffle that is co-extensive with the front opening of housing 2. In the embodiment shown, baffle 7 has a thickness or depth of approximately 1.0 inch, and is preferably composed of convoluted chipboard. It has been found that convoluted chipboard is well suited for use as the baffles 1, 3 and 5 of the present invention due to its non-shattering and non-splintering characteristics.

The baffle 7 is supported within chamber 3 by means of the ribs or spacers 12 and 13 which are secured by bolts 16 to the sides and bottom of shell 4. Spacer 12 abuts the front or outer face of baffle 7 and spacer 13 abuts the rear or inner face of baffle 7 to support baffle 7 in an upright position. The spacer 12 is a continuous tube-like structure encircling the inner peripheral surfaces of housing 2 along the front edge margin of shell 4. In contrast, spacer 9 is substantially U-shaped and positioned so that its open side faces the top of housing 2, as seen in FIG. 3.

The middle or third layer 9 also comprises a baffle which is disposed parallel to baffle 7 at the approximate midpoint of the depth of spending chamber 3. The baffle 9 is also formed of convoluted chipboard having a preferred composition identical to that for baffle 7. However, as seen in FIG. 3, the baffle 9 has a greater depth than baffle 7 and preferably has a depth of about 3.0 inches. Thus, the ratio of the depth of baffle 7 to the depth of baffle 9 is about 1 to 3. The baffle 9 is supported in its upright position within housing 2 by means of identical U-shaped spacers 13 and 14. The spacer 13 abuts the front face of baffle 9 while the spacer 14 abuts the rear face of baffle 9 to support baffle 9 in its proper orientation.

The fifth or back layer 11 also forms a baffle positioned along the back edge margin of housing 2 which extends parallel to baffles 7 and 9. The baffle 11 preferably has a depth of 1.0 inch and is formed of convoluted chipboard having a preferred composition identical to that for baffles 7 and 9. The baffle 11 is supported in an upright position within housing 2 by means of spacers 14 and 15. The spacer 14 abuts the inner surface of baffle 11 and spacer 15 which is identical to spacer 12 abuts the front or outer surface of baffle 11. Thus, baffles 7, 9 and 11 are all parallel to one another and equally spaced from one another by means of spacers 12–15 which, in the embodiment, have a depth of about 2.0 inches each. Spacers 13 and 14 form cavities between baffles 7, 9 and 11 for receiving the particulate matter of layers 8 and 10, as will hereinafter be described.

The convolutely wound chipboard material referred to herein is formed by a multiplicity of superimposed substantially coplanar plies of paper material, and a multiplicity of layers of adhesive material interposed between each paper ply. The adhesive layers bond the plies together into a rigid laminate.

The laminate is preferably manufactured by convolutely winding a continuous web of sheet-like paper into a multi-ply tube. The tube is constructed by winding a web of paper or chipboard continuously about a rotating mandrel until the desired number of convolutions is built up to form the desired wall thickness for the tube. Generally, the wall thickness ranges from about 0.5 to about 1.0 inches. The web of the paper material is fed to the mandrel in a direction such that the plane of the web is substantially perpendicular to the axis of the mandrel. As the paper web advances towards the mandrel, an adhesive is applied thereto. At the same time, the paper web is subjected to lengthwise tension and to thicknesswise compression so that the plies of paper are bonded together into a rigid laminate construction. Once the desired wall thickness is reached, the tubular structure is removed from the mandrel and cut into the desired shapes.

The mandrel may be rectangular in cross section so that the tubular structure has opposed pairs of substantially parallel sides intervened by curved or rounded corners, or may be circular, eliptical, oblong, etc. in cross section so that components cut from the tubular structure may be preformed with various desired curvatures and shapes.

In the past such convolutely wound tubular structures have been used as forms for concrete columns s well as in the manufacture of various furniture parts such as the backs, arms, and feet of chairs as shown in Weller, U.S. Pat. No. 3,371,963.

It has been unexpectably discovered that a convolutely wound tube formed by a multiplicity of plies of paper material adhesively bonded together into a rigid laminate makes an excellent structure for bullet targets and components for such targets. Tubular structures made of convolutely wound paper materials may easily be cut into the various target shapes, and may be preformed with bulit-in curvatures corresponding to the shape of the mandrel being used. Thus, the housing 2, spacers 12–15 and baffles 7, 9 and 11 are all preferably composed of such target material.

Each ply of paper material is preferably of recycled chipboard having a caliper or thickness of from about 0.025 to about 0.035 inches. Also, the moisture conent of each ply is preferably from about 3.5% to about 5.5%. The use of recycled paper fibers as the raw material for the plies is particularly advantageous for use with the bullet trap since recycled chipboard has paper fibers that are relatively short and tightly packed. These fibers provided a paper web that has a desity of from about 3.0 to about 3.5 lbs./point of caliper. A paper web having such a range of density caliper and moisture content is particularly advantageous for use in making a convolutely wound tubular structure since such a moisture content is sufficient to permit the web to absorb the adhesive, and such a density and caliper provides sufficient strength in both the machine direction and cross direction to withstand the tension and compression applied during the winding process. It has been found that a ply of recycled chipboard having a minimum plybond characteristic of about 0.125 lbs./sq. inch measured by the standard U-block method of testing is adequate for use in the bullet trap.

The density, caliper and moisture content of each individual ply is also important in the discovery that such a convolutely wound laminate construction may be used as a target material. Since the fibers are short and tightly packed they provide a paper material which will not shatter or splinter when penetrated by a bullet. In contrast, plywood has long and relatively loose fibers and tends to shatter or splinter as the bullet exits its back face. Thus, a target material made of convolutely wound recycled paper plies provides a target which has a relatively longer life than plywood targets components.

The following has been determined to be the preferred characteristics of each individual ply of recycled raw material:

Caliper-0.030 inches
Moisture-5.5% maximum
Weight-0.105 lbs. per thousand sq. ft.
Density-3.5 lbs. per point of caliper A "point" as used herein refers to and is equal to 0.001 inches. Therefore, a paper web having a density of 3.5 pounds per point means that one thousand square feet of paper having a thickness of 0.001 inches would weigh 3.5 pounds.

The multiple plies of paper material are bonded together by a multiplicity of layers of adhesive. The adhesive is preferably polyvinyl alcohol, and therefore each ply of recycled chipboard should preferably contain no more than about 5.5% moisture so that the adhesive may be thoroughly absorbed in the paper. However, the paper plies may be bonded together by any of a wide range of adhesives.

The following data was computed from a laminate constructed in accordance with the aforementioned procedure. The thickness of the sample material was 0.422 inches.

| | |
|---|---|
| Modules of Rupture | |
| Machine Direction | 3197 psi |
| Cross Direction | 2135 psi |
| Staple Holding Power | |
| Edge - Machine Direction | 14.7 lbs. |
| Edge - Cross Direction | 18.9 lbs. |
| Surface - Machine Direction | 21.4 lbs. |
| Surface - Cross Direction | 21.6 lbs. |
| Bolt Holding Power | 1375 lbs. |
| Tensile Strength | |
| Machine Direction | 1765 lbs./in. |
| Cross Direction | 800 lbs./in. |

The above samples were preconditioned at least 48 hrs. at less than 35% relative humidity and then conditioned at least 72 hours at 50% relative humidity at 23° centigrade prior to testing. The modulus of rupture was computed from center load beam tests and is a determination of the amount of pressure applied to the laminate construction to make it crack. Staple holding power was measured with ⅜ inch by ⅜ inch steel chisel point staples and is a measurement of the amount of force needed to pull out such a staple once embedded into the laminate construction. Bolt holding power is the maximum force required to pull a 0.25 inch bolt and washer through the sample. The tensile strength is a measure of the resistance of the sample to rupture under tension. In other words, tensile strength is a measure of the greatest longitudinal stress the sample could bear without tearing apart.

In other tests the ZDT strength of various unconditioned samples was mesured and was found to range from about 66 psi to about 81 psi. The ZDT test is performed by attaching a one inch diameter steel block to either side of the laminate sample being tested. Opposite pulling force is then applied to the blocks and the amount of force required to pull the paper apart is the ZDT strength. This characteristic is sometimes referred to the Z-direction tensile strength and is similar to a U-block ply bond test.

A laminate made from convolutely wound paper plies adhesively bonded together provides an excellent target material which is non-shattering and non-splintering.

As seen best in FIG. 3, the bed of energy absorbing material includes two layers or columns 8 and 10 of particulate material or matter packed between baffles 7, 9 and 11 and filled to the top of housing 2. Preferably, the particulate material comprises pea gravel having an effective diameter of from about 150 to about ⅜ inches, and each layer 8 and 10 has a depth of about 2.0 inches. Thus, the ratio of the depth (i.e. thickness) of baffles 7 and 11 to that of pea gravel layers 8 and 10, respectively, is about 1 to 2. The pea gravel layers or columns 8 and 10 shatter and disintegrate a bullet upon impact. Thus, particulate materials other than pea gravel may be used in the layers 8 and 10 so long as it has the requisite hardness and diameter needed to shatter a bullet. For example, particles less than about 150 inch will not effectively shatter a bullet while particles greater than about ⅜ inch provide interstices of substantial area which may permit a bullet to pass through the layers 8 and 10 without being effectively shattered.

In operation, bullets shot at the open front end of bullet trap 1 will penetrate baffle 7 and will generally be shattered and disintegrated by the pea gravel layer 8. The baffle 9 provides a solid backstop for the pea gravel layer 8 and thus absorbs the impact of the bullet to aid the pea gravel layer 8 in shattering the bullet. Baffles 7 and 9 also provide a means for supporting or maintaining the pea gravel layer 8 in an upright column. Baffles 9 and 11 act in the same manner to support or retain pea gravel layer 10 in an upright column. Table 1 shows the ballistics tests for various caliber bullets having different points used with the bullet trap 1 from various distances. Table 1 shows that each of the various bullets were stopped in the pea gravel layer 8.

Upon impact with pea gravel layer 8, the bullet as well as some of the individual particles of pea gravel tend to disintegrate into much smaller pieces. Thus, after numerous rounds have been fired into bullet trap 1, the pea gravel layer 9 will have settled slightly so that at periodic times it is necessary to remove cover 5 and refill layer 15 with additional pea gravel.

The back of bullet trap 1 is identical to the front. Thus, after baffle 7 has been penetrated by numerous bullets to the extent that it is worn out and should be replaced, bullet trap 1 need only be reversed so that its back, i.e. baffle 11 faces the shooter.

It should be noted that the upwardly directed openings of spacers 13 and 14 (as seen best in FIG. 3) provide a convenient mechanism for emptying the pea gravel from layers 8 and 10. Once empty of particulate matter, the bullet trap 1 is light in weight and becomes portable so that it may easily be transported from place to place.

TABLE 1

| Caliper | Point | Distance | Rounds | Layer Bullet Stopped In |
|---|---|---|---|---|
| 3006 | JSP* | 36 ft. | 12 | Stopped in pea gravel |
| 444 | JSP | 36 ft. | 13 | Stopped in pea gravel |
| 3006 | JSP | 36 ft. | 4 | Stopped in pea gravel |
| 444 | JSP | 36 ft. | 3 | Stopped in pea gravel |
| 3006 | JSP | 100 ft. | 3 | Stopped in pea gravel |
| 3006 | JSP | 5 ft. | 1 | Stopped in pea gravel |
| 44 | Lead | 36 ft. | 20 | Stopped in pea gravel |
| 38 | JHP** | 36 ft. | 12 | Stopped in pea gravel |
| 9 mm. | Lead | 36 ft. | 20 | Stopped in pea gravel |

*Jacketed Soft Point
**Jacketed Hollow Point

The bullet trap 1 includes a housing 2 defining a bullet spending chamber 3, and a bed of different layers energy absorbing material contained within the housing 2 for stopping a fired bullet. Various modifications and substitutions may be made to the components described. For example, baffles comprised of convoluted fiberboard may be substituted for the pea gravel layers 9 and 10, or additional baffles may be added to the structure. In addition, layers comprised of empty cavities may be left between adjacent layers if desired. Furthermore, the depth of each layer may be varied depending upon the tensile strength and puncture modulus of the materials being used as well as other factors such as the type of weapon or bullet being used by a shooter.

Various modes of carrying out the invention are contemplated as being within the scope of the following claims particularly pointing out and distinctly claiming the subject matter which is regarded as the invention.

I claim:

1. A bullet trap, comprising:

a housing open at one end and defining a bullet spending chamber; and a de-energizing bed contained within the housing for stopping a fired bullet, said de-energizing bed including a plurality of layers of energy absorbing material with at least two of said layers having different energy absorbing characteristics, one of said energy absorbing layers includes a baffle extending transversely in said chamber and parallel to said opening, said baffle includes a multiplicity of plies of paper sheets adhesively bonded together into a rigid laminate.

2. A bullet trap, comprising:

a housing open at one end and defining a bullet spending chamber; and a de-energizing bed contained within the housing for stopping a fired bullet, said de-energizing bed including a plurality of layers of energy absorbing material with at least two of said layers having different energy absorbing characteristics, one of said layers includes a baffle composed of a multi-ply paper laminate, and another of said layers including particulate material wherein each particle has an effective diameter of from about $\frac{1}{8}$ to about $\frac{3}{8}$ inches.

3. The bullet trap of claim 2, wherein the ratio of the thickness of said one layer to the thickness of said another layer is about 1 to 2.

4. The bullet trap of claim 2, wherein said plies of said one layer is composed of chipboard, and said another layer is composed of pea gravel.

5. The bullet trap of claim 2, further including a third layer of energy absorbing material positioned so that said particulate material layer is disposed between said one layer and said third layer, said third layer comprising a baffle composed of a multi-ply paper laminate.

6. The bullet trap of claim 5, wherein the ratio of the depth of said one layer to the depth of said particulate material layer is about 1 to 2, and the ratio of the depth of said one layer to the depth of said third layer is about 1 to 3.

7. The bullet trap of claim 6, wherein said plies of said one layer and said third layer are composed of chipboard, and said particulate material layer is composed of pea gravel.

8. The bullet trap of claim 2, wherein said housing is composed of a multi-ply paper laminate.

9. The bullet trap of claim 2 or 5, wherein said layers are co-extensive with said opening.

10. A bullet trap, comprising:

means including particulate matter to distintegrate a bullet, and means to maintain said particulate matter in a column and to permit the bullet to have access to said particulate matter without richocheting prior to engaging said particulate matter, said last-named means composed of a multi-ply paper laminate adhesively bonded together into a rigid laminate.

11. The bullet trap of claim 10, wherein each particle of particulate matter has an effective diameter of from about $\frac{1}{8}$ to about $\frac{3}{8}$ inches.

12. The bullet trap of claim 10, wherein said particulate matter includes pea gravel.

13. A bullet trap, comprising means including a rigid laminate formed of substantially coplanar plies of paper held together by adhesive to permit the passage of a bullet therethrough without shattering and splintering the laminate, means including a column of particulate matter to engage and disintegrate the bullet after passing through said laminate, and means to retain said column of particulate matter adjacent to said laminate.

14. The bullet trap of claim 13, wherein said particulate matter includes pea gravel.

15. The bullet trap of claim 13, including second means including a second rigid laminate formed of substantially coplanar plies of paper held together by adhesive to permit the passage of a bullet therethrough without shattering and splintering the laminate, second means including a second column of particulate matter to engage and disintegrate the bullet after passing through said second laminate, said retaining means retaining said second column of particulate matter adjacent said second laminate to form a second trap portion oppositely spaced from a first trap portion consisting of said first laminate and said first column of particulate matter to provide a reversible trap for multiple use.

16. The bullet trap of claim 13, wherein said retaining means includes a cavity to retain said column of particulate matter and an opening to selectively remove said particulate matter from said cavity to assist in transporting said trap without undue weight.

17. A bullet trap, comprising a housing of superimposed substantially coplanar plies of sheet-like paper joined by intervening adhesive forming a rigid laminate tubular structure having a central opening along a tubular axis, a first baffle of superimposed substantially coplanar plies of sheet-like paper joined by intervening adhesive forming a rigid laminate located at a first axial position within said housing to substantially enclose said central opening and permit the passage of the bullet therethrough without shattering and splintering said first baffle, a second baffle of superimposed substantially coplanar plies of sheet-like paper joined by intervening adhesive forming a rigid laminate at a second axial position within said housing to substantially enclose said central opening, said second baffle spaced from said first baffle to provide a cavity substantially surrounded by said first and second baffles and said housing, and pea gravel located within said cavity to engage and disintegrate the bullet after passing through said first baffle.

18. A portable bullet trap, comprising a portable housing of superimposed substantially coplanar plies of sheet-like paper joined by intervening adhesive forming a first rigid laminate tube having an internal wall forming a central opening along a tubular axis disposed generally in the direction of the line of fire, a second rigid laminate tube of superimposed substantially coplanar plies of sheet-like paper joined by intervening adhesive located at a first end of said housing opening and having an outer wall located adjacent to said internal wall of said first tube and a central opening aligned substantially along said tubular axis, a first baffle of superimposed substantially coplanar plies of sheet-like paper joined by intervening adhesive forming a rigid laminate located within said housing opening and abutting said second tube to substantially enclose said central opening and permit the passage of the bullet therethough without shattering and splintering said first baffle, a U-shaped member of superimposed substantially coplanar plies of sheet-like housing opening and abutting said U-shaped bottom portion of said housing and abutting said first baffle, a second baffle located within said housing opening and abutting said U-shaped member to substantially enclose said central opening, and a column of pea gravel located within a cavity formed between said first and second baffles and said U-shaped member to engage and disintegrate the bullet after passing through said first baffle, said top wall of said first tube selectively movable to remove said pea gravel to assist in transporting said trap without undue weight.

19. The portable trap of claim 18, wherein said second baffle is composed of superimposed substantially coplanar plies of sheet-like paper joined by intervening adhesive forming a rigid laminate to permit the passage of bullet fragments that are not disintegrated by said first pea gravel column, a second U-shaped member of superimposed substantially coplanar plies of sheet-like housing opening and abutting said U-shaped bottom portion of said housing and abutting said first baffle, a third baffle located within said housing opening and abutting said second U-shaped member to substantially enclose said second cavity, a third rigid laminate tube of superimposed substantially coplanar plies of sheet-like paper joined by intervening adhesive located at a first end of said housing opening and having an outer wall located adjacent to said internal wall of said first tube and a central opening aligned substantially along said tubular axis, and a second column of pea gravel located within said second cavity formed by the space between said second and third baffles and said second U-shaped member to engage and disintegrate any bullet fragments that may have passed through said second baffle to provide a redundant means of bullet disintegration.

* * * * *

UNITED STATES PATENT AND TRADEMARK OFFICE

CERTIFICATE OF CORRECTION

PATENT NO. : 4,445,693

DATED : May 1, 1984

INVENTOR(S) : RICHARD B. ANGWIN

It is certified that error appears in the above-identified patent and that said Letters Patent are hereby corrected as shown below:

| | |
|---|---|
| Col. 4, Line 4 | after "columns" delete "s" and substitute therefor ---as--- |
| Col. 4, Line 27 | delete "provided" and substitute therefor ---provide--- |
| Col. 4, Line 27 | delete "desity" and substitute therefor ---density--- |
| Col. 5, Line 40 | delete "mesured" and substitute therefor ---measured--- |
| Col. 5, Line 58 | delete "150" and substitute therefor ---1/8--- |

UNITED STATES PATENT AND TRADEMARK OFFICE

CERTIFICATE OF CORRECTION

PATENT NO. : 4,445,693

DATED : May 1, 1984

INVENTOR(S) : RICHARD B. ANGWIN

It is certified that error appears in the above-identified patent and that said Letters Patent is hereby corrected as shown below:

Col. 5, Line 67 delete "150" and substitute therefor ---1/8---

Signed and Sealed this

*Fifth* Day of *March 1985*

[SEAL]

*Attest:*

DONALD J. QUIGG

*Attesting Officer* *Acting Commissioner of Patents and Trademarks*